US009322557B2

(12) United States Patent
Uhm et al.

(10) Patent No.: US 9,322,557 B2
(45) Date of Patent: Apr. 26, 2016

(54) COMBUSTOR AND METHOD FOR DISTRIBUTING FUEL IN THE COMBUSTOR

(75) Inventors: Jong Ho Uhm, Simpsonville, SC (US); Willy Steve Ziminsky, Simpsonville, SC (US); Thomas Edward Johnson, Greer, SC (US); William David York, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1149 days.

(21) Appl. No.: 13/343,926

(22) Filed: Jan. 5, 2012

(65) Prior Publication Data

US 2013/0174568 A1 Jul. 11, 2013

(51) Int. Cl.

| | |
|---|---|
| ***F02C 7/22*** | (2006.01) |
| ***F23R 3/54*** | (2006.01) |
| ***F23R 3/28*** | (2006.01) |
| *F23R 3/04* | (2006.01) |

(52) U.S. Cl.

CPC ..... *F23R 3/283* (2013.01); *F23R 3/286* (2013.01); *F23D 2209/10* (2013.01); *F23D 2209/20* (2013.01); *F23R 2900/03044* (2013.01)

(58) Field of Classification Search

CPC ..... F02C 7/22; F02C 7/222; F02C 7/228; F23R 3/045; F23R 3/283; F23R 3/286

USPC ..... 60/737, 742

See application file for complete search history.

(56) References Cited

U.S. PATENT DOCUMENTS

| | | | | |
|---|---|---|---|---|
| 3,771,500 | A | 11/1973 | Shakiba | |
| 4,100,733 | A * | 7/1978 | Striebel et al. | 60/39.463 |
| 4,104,873 | A | 8/1978 | Coffinberry | |
| 4,412,414 | A | 11/1983 | Novick et al. | |
| 5,104,310 | A | 4/1992 | Saltin | |
| 5,205,120 | A | 4/1993 | Obländer et al. | |
| 5,213,494 | A | 5/1993 | Jeppesen | |
| 5,341,645 | A | 8/1994 | Ansart et al. | |

(Continued)

FOREIGN PATENT DOCUMENTS

| | | |
|---|---|---|
| CN | 2418426 Y | 2/2001 |
| CN | 201731490 U | 2/2011 |

(Continued)

OTHER PUBLICATIONS

Unofficial English Translation of Chinese Office Action issued in connection with corresponding CN Application No. 201210436139.1 on Aug. 24, 2015.

*Primary Examiner* — Ehud Gartenberg
*Assistant Examiner* — Filippo Manfredi
(74) *Attorney, Agent, or Firm* — Dority & Manning, PA

(57) ABSTRACT

A combustor includes a tube bundle that extends radially across at least a portion of the combustor. The tube bundle includes an upstream surface axially separated from a downstream surface. A plurality of tubes extends from the upstream surface through the downstream surface, and each tube provides fluid communication through the tube bundle. A baffle extends axially inside the tube bundle between adjacent tubes. A method for distributing fuel in a combustor includes flowing a fuel into a fuel plenum defined at least in part by an upstream surface, a downstream surface, a shroud, and a plurality of tubes that extend from the upstream surface to the downstream surface. The method further includes impinging the fuel against a baffle that extends axially inside the fuel plenum between adjacent tubes.

20 Claims, 7 Drawing Sheets

(56) References Cited

U.S. PATENT DOCUMENTS

| | | | | |
|---|---|---|---|---|
| 5,361,586 | A * | 11/1994 | McWhirter | F23D 14/02 60/737 |
| 5,439,532 | A | 8/1995 | Fraas | |
| 5,592,819 | A | 1/1997 | Ansart et al. | |
| 5,707,591 | A | 1/1998 | Semedard et al. | |
| 5,950,547 | A | 9/1999 | Wachendorfer | |
| 6,089,025 | A * | 7/2000 | Tekriwal et al. | 60/737 |
| 6,098,407 | A | 8/2000 | Korzendorfer et al. | |
| 6,123,542 | A | 9/2000 | Joshi et al. | |
| 6,394,791 | B2 | 5/2002 | Smith et al. | |
| 6,438,961 | B2 | 8/2002 | Tuthill et al. | |
| 6,796,790 | B2 | 9/2004 | Venizelos et al. | |
| 6,983,600 | B1 | 1/2006 | Dinu et al. | |
| 7,003,958 | B2 | 2/2006 | Dinu et al. | |
| 7,007,478 | B2 | 3/2006 | Dinu | |
| 7,631,499 | B2 | 12/2009 | Bland | |
| 7,752,850 | B2 | 7/2010 | Laster et al. | |
| 9,074,772 | B2 | 7/2015 | Miura et al. | |
| 2004/0216463 | A1 | 11/2004 | Harris | |
| 2008/0016876 | A1 | 1/2008 | Colibaba-Evulet et al. | |
| 2008/0304958 | A1 | 12/2008 | Norris et al. | |
| 2009/0229269 | A1 * | 9/2009 | Lacy et al. | 60/737 |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0089367 | A1 | 4/2010 | Johnson et al. | |
| 2010/0095676 | A1 | 4/2010 | Uhm et al. | |
| 2010/0139280 | A1 | 6/2010 | Lacey et al. | |
| 2010/0186413 | A1 | 7/2010 | Lacey et al. | |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0089266 | A1 | 4/2011 | Stoia et al. | |

FOREIGN PATENT DOCUMENTS

| | | | |
|---|---|---|---|
| CN | 102032569 | A | 4/2011 |
| EP | 1959197 | A2 | 8/2008 |

* cited by examiner

COMBUSTOR AND METHOD FOR DISTRIBUTING FUEL IN THE COMBUSTOR

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves a combustor and method for distributing fuel in the combustor.

BACKGROUND OF THE INVENTION

Combustors are commonly used in industrial and power generation operations to ignite fuel to produce combustion gases having a high temperature and pressure. For example, turbo-machines such as gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by the nozzles, possibly causing severe damage to the nozzles in a relatively short amount of time. In addition, higher combustion gas temperatures generally increase the disassociation rate of diatomic nitrogen, increasing the production of nitrogen oxides ($NO_x$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, the combustor may include an end cap that radially extends across at least a portion of the combustor, and a plurality of tubes may be radially arranged in one or more tube bundles across the end cap to provide fluid communication for the working fluid through the end cap and into the combustion chamber. Fuel may be supplied to a fuel plenum inside the end cap to flow around the tubes and provide convective cooling to the tubes. The fuel may then flow into the tubes and mix with the working fluid flowing through the tubes before flowing out of the tubes and into the combustion chamber.

Although effective at enabling higher operating temperatures while protecting against flashback or flame holding and controlling undesirable emissions, the fuel flowing around and into the tubes may not be evenly distributed. Specifically, the tubes themselves may block the fuel flow and prevent the fuel from evenly flowing over the side of the tube opposite from the direction of the fuel flow. As a result, the convective cooling provided by the fuel and the fuel concentration flowing through the premixer tubes may vary radially across the tube bundle. Both effects may create localized hot spots and/or fuel streaks in the combustion chamber that reduce the design margins associated with flashback or flame holding and may increase undesirable emissions. Therefore, a combustor and method for distributing fuel in the combustor that improves the fuel distribution and cooling would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor that includes a tube bundle that extends radially across at least a portion of the combustor, wherein the tube bundle comprises an upstream surface axially separated from a downstream surface. A plurality of tubes extends from the upstream surface through the downstream surface, and each tube provides fluid communication through the tube bundle. A baffle extends axially inside the tube bundle between adjacent tubes.

Another embodiment of the present invention is a combustor that includes a tube bundle that extends radially across at least a portion of the combustor. The tube bundle comprises an upstream surface axially separated from a downstream surface. A shroud circumferentially surrounds the upstream and downstream surfaces to at least partially define a fuel plenum inside the tube bundle. A plurality of tubes extends from the upstream surface through the downstream surface of the tube bundle, and each tube provides fluid communication through the tube bundle. The combustor further includes means for distributing fuel around the plurality of tubes.

The present invention may also include a method for distributing fuel in a combustor that includes flowing a fuel into a fuel plenum defined at least in part by an upstream surface, a downstream surface axially separated from the upstream surface, a shroud that circumferentially surrounds the upstream and downstream surfaces, and a plurality of tubes that extend from the upstream surface to the downstream surface. The method further includes impinging the fuel against a baffle that extends axially inside the fuel plenum between adjacent tubes.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
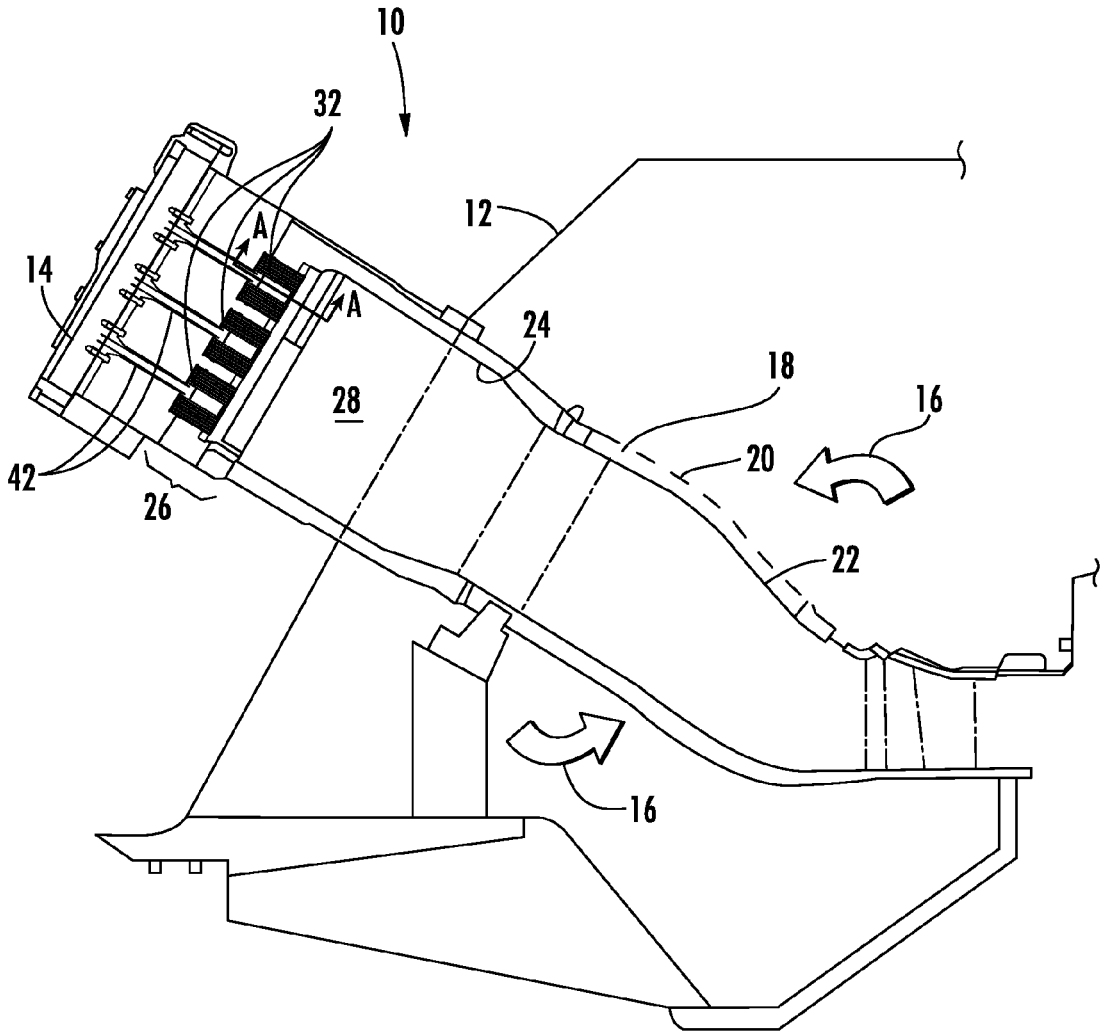
FIG. 1 is a simplified side cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and method for distributing fuel in the combustor. The combustor generally includes a tube bundle having a plurality of tubes that allows fuel and working fluid to thoroughly mix before entering a combustion chamber. In particular embodiments, the combustor also includes a baffle or means for distributing the fuel around the tubes to enhance cooling to the tubes. Although exemplary embodiments of the present invention will be described generally in the context of a combustor incorporated into a turbo-machine such as a gas turbine for purposes of illustration, one of ordinary skill in the art will readily appreciate that embodiments of the present invention may be applied to any combustor and are not limited to a turbo-machine combustor unless specifically recited in the claims.

FIG. 1 shows a simplified side cross-section of an exemplary combustor 10, such as would be included in a gas turbine, according to one embodiment of the present invention. A casing 12 and end cover 14 may surround the combustor 10 to contain a working fluid 16 flowing to the combustor 10. The working fluid 16 may pass through flow holes 18 in an impingement sleeve 20 to flow along the outside of a transition piece 22 and liner 24 to provide convective cooling to the transition piece 22 and liner 24. When the working fluid 16 reaches the end cover 14, the working fluid 16 reverses direction to flow through an end cap 26 and into a combustion chamber 28 downstream from the end cap 26.

Figure 2:
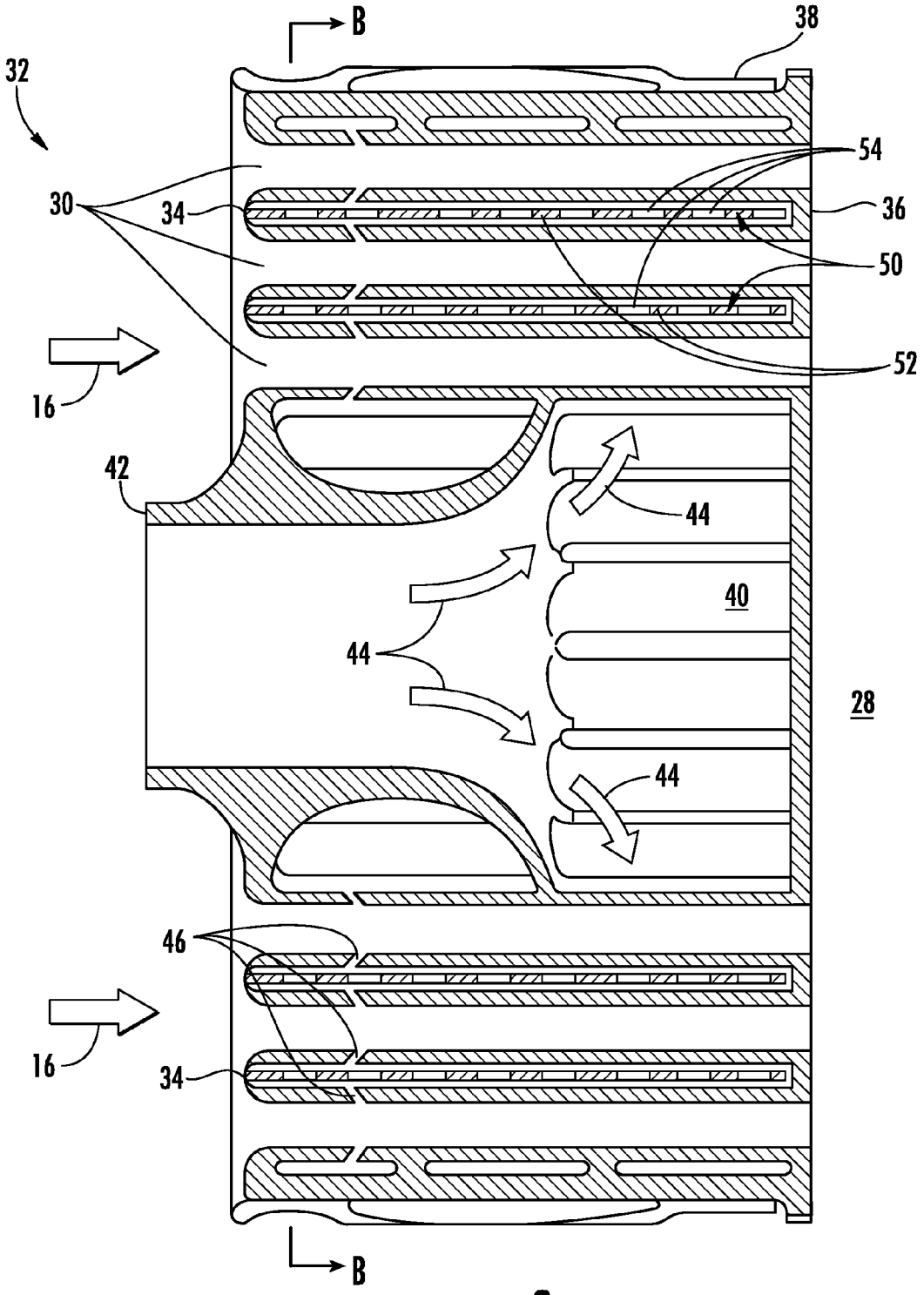
FIG. 2 is an enlarged side cross-section view of a tube bundle shown in FIG. 1 taken along line A-A according to a first embodiment of the present invention.
Figure 3:
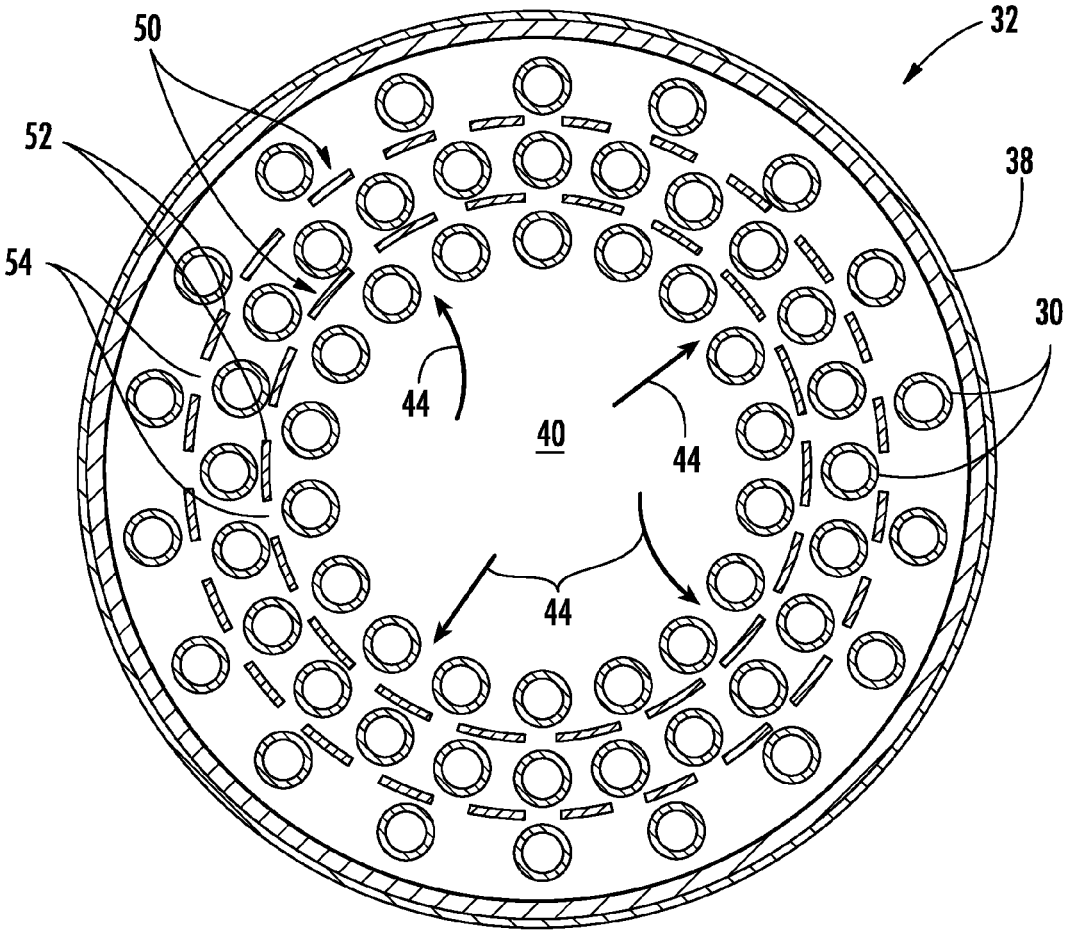
FIG. 3 is an axial cross-section view of the tube bundle shown in FIG. 2 taken along line B-B.

The end cap 26 may include a plurality of tubes 30 radially arranged in one or more tube bundles 32. FIG. 2 provides an enlarged side cross-section view of an exemplary tube bundle 32 shown in FIG. 1 taken along line A-A according to a first embodiment of the present invention, and FIG. 3 provides an axial cross-section view of the tube bundle 32 shown in FIG. 2 taken along line B-B. As shown, each tube bundle 32 generally includes an upstream surface 34 axially separated from a downstream surface 36, and the tubes 30 extend from the upstream surface 34 to the downstream surface 36 to provide fluid communication for the working fluid 16 to flow through the tube bundle 32 to the combustion chamber 28. A shroud 38 circumferentially surrounds the upstream and downstream surfaces 34, 36 to at least partially define a fuel plenum 40 inside the tube bundle 32. A fuel conduit 42 may extend through the upstream surface 34 and/or shroud 38 to provide fluid communication for fuel 44 to flow into the fuel plenum 40 in each tube bundle 32. One or more of the tubes 30 may include a fuel port 46 that provides fluid communication from the fuel plenum 40 into the one or more tubes 30. The fuel ports 46 may be angled radially, axially, and/or azimuthally to project and/or impart swirl to the fuel 44 flowing through the fuel ports 46 and into the tubes 30. In this manner, the working fluid 16 may flow into the tubes 30, and fuel 44 from the fuel plenum 40 may flow through the fuel ports 46 and into the tubes 30 to mix with the working fluid 16. The fuel-working fluid mixture may then flow through the tubes 30 and into the combustion chamber 28.

The particular shape, size, and number of tubes 30 and tube bundles 32 may vary according to particular embodiments. For example, the tubes 30 are generally illustrated as having a cylindrical shape; however, alternate embodiments within the scope of the present invention may include tubes 30 having virtually any geometric cross-section. Similarly, the combustor 10 may include a single tube bundle 32 that extends radially across the entire end cap 26, or the combustor 10 may include multiple circular, triangular, square, oval, or pie-shaped tube bundles 32 in various arrangements in the end cap 26. One of ordinary skill in the art will readily appreciate that the shape, size, and number of tubes 30 and tube bundles 32 is not a limitation of the present invention unless specifically recited in the claims.

As shown in FIGS. 2 and 3, each tube bundle 32 further includes means for distributing the fuel 44 around the tubes 30. Distributing the fuel 44 radially around the tubes 30 allows the fuel 44 to more evenly exchange heat with the tubes 30, reducing localized hot spots in the tubes 30 that might lead to flame holding or flashback conditions. In addition, the more evenly distributed fuel 44 results in more even fuel flow through the fuel ports 46 into the tubes 30, reducing any local hot streaks or high fuel concentrations in the combustion chamber 28 that might increase undesirable emissions.

The structure associated with distributing the fuel 44 radially around the tubes 30 may include any flow-directing vane, panel, guide, or other type of baffle suitable for continuous exposure in the temperatures and pressures associated with the combustor 10. For example, in the particular embodiment shown in FIGS. 2 and 3, the means for distributing the fuel 44 around the tubes 30 is a baffle 50 generally located between adjacent tubes 30 inside the fuel plenum 40 to redirect the fuel 44 around the tubes 30. In particular embodiments, the baffle 50 may extend axially from the upstream surface 34 to the downstream surface 36. Alternately or in addition, the baffle 50 may be aligned substantially parallel to the tubes 30 or angled axially with respect to the tubes 30 to distribute the fuel 44 axially as well as radially inside the fuel plenum 40.

As shown in FIGS. 2 and 3, the baffle 50 may include one or more plates 52 having perforations 54 or slots through the plates 52. The solid portion of the plates 52 may redirect the fuel 44 around the tubes 30, and the perforations 54 or slots in the plates 52 may allow the fuel 44 to pass through the plates 52 at desired locations to more evenly distribute the fuel flow through the fuel plenum 40. In particular embodiments, the perforations 54 or slots may be longer axially than circumferentially, and the perforations 54 or slots may be radially aligned with the tubes 30 to allow the fuel 44 to pass through the plates 52 at a particular location relative to the tubes 30. For example, in the particular embodiment shown in FIGS. 2 and 3, the fuel 44 generally flows radially outward in all directions from the fuel conduit 42. The solid portion of the plates 52 redirects the fuel flow around the tubes 30, and the perforations 54 or slots in the plates are radially aligned with the tubes 30 to preferentially allow the fuel 44 to flow across the radially outer portion of the tubes 30. In this manner, the fuel 44 is more evenly distributed through the fuel plenum 40 and provides more even cooling to all surfaces around the tubes 30.

Figure 4:
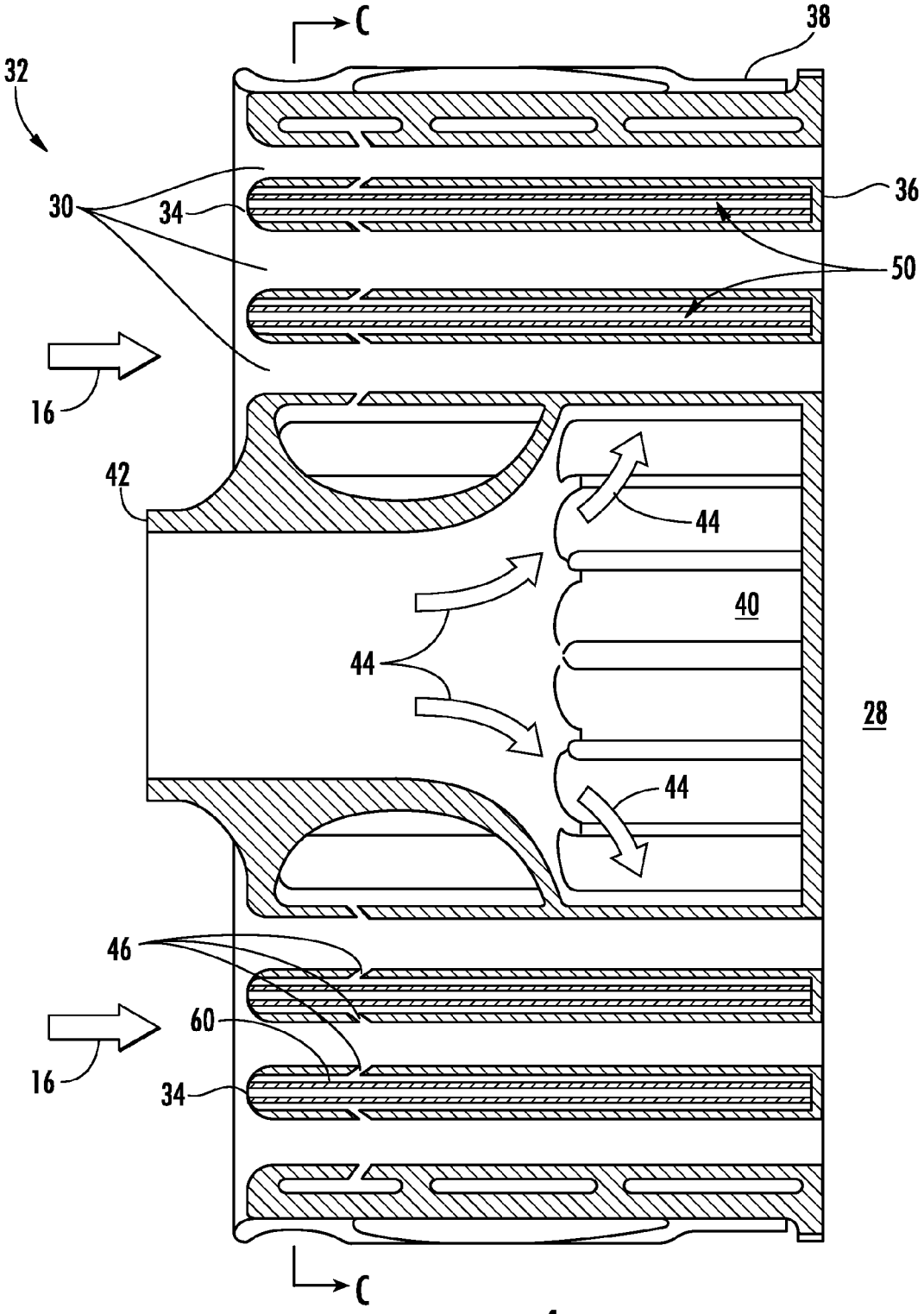
FIG. 4 is an enlarged side cross-section view of a tube bundle shown in FIG. 1 taken along line A-A according to a second embodiment of the present invention.
Figure 5:
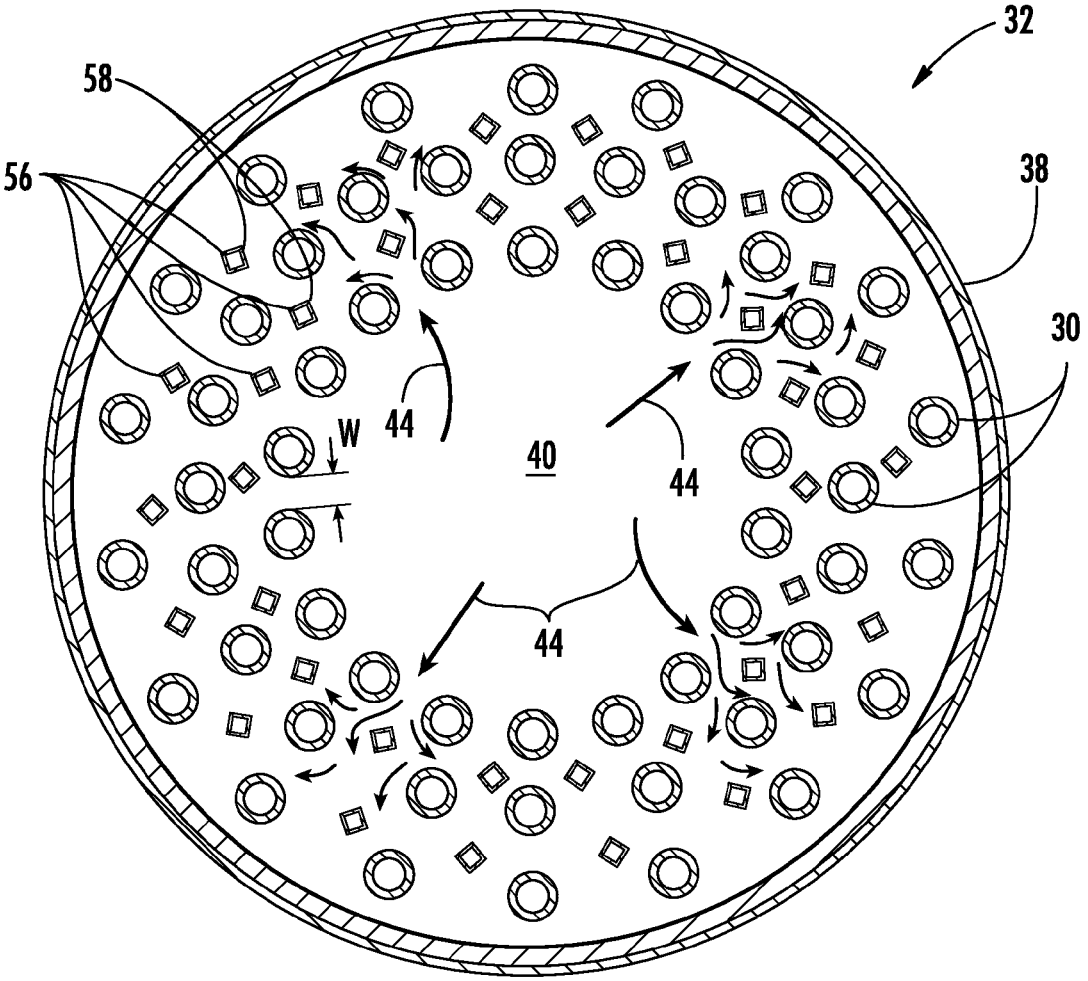
FIG. 5 is an axial cross-section view of the tube bundle shown in FIG. 4 taken along line C-C.
Figure 6:
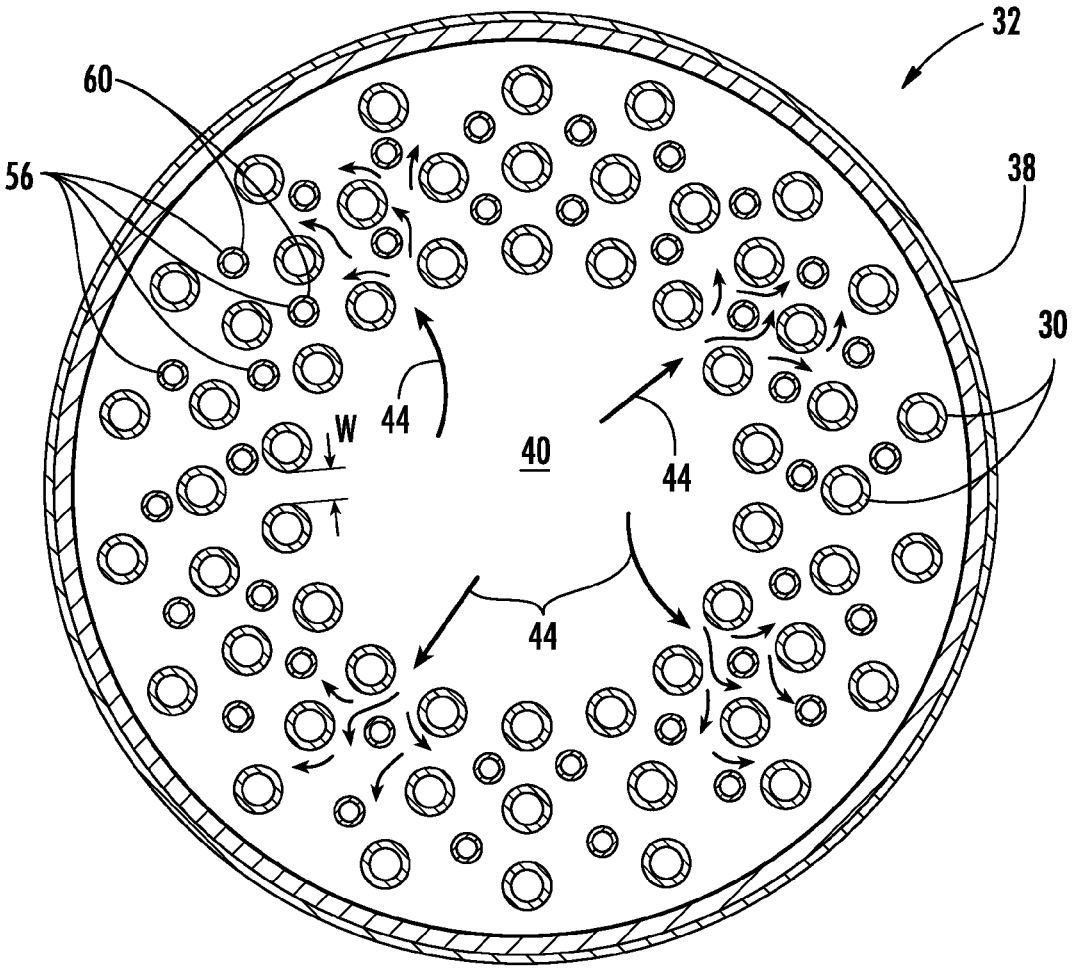
FIG. 6 is an axial cross-section view of the tube bundle shown in FIG. 4 taken along line C-C according to an alternate embodiment.
Figure 7:
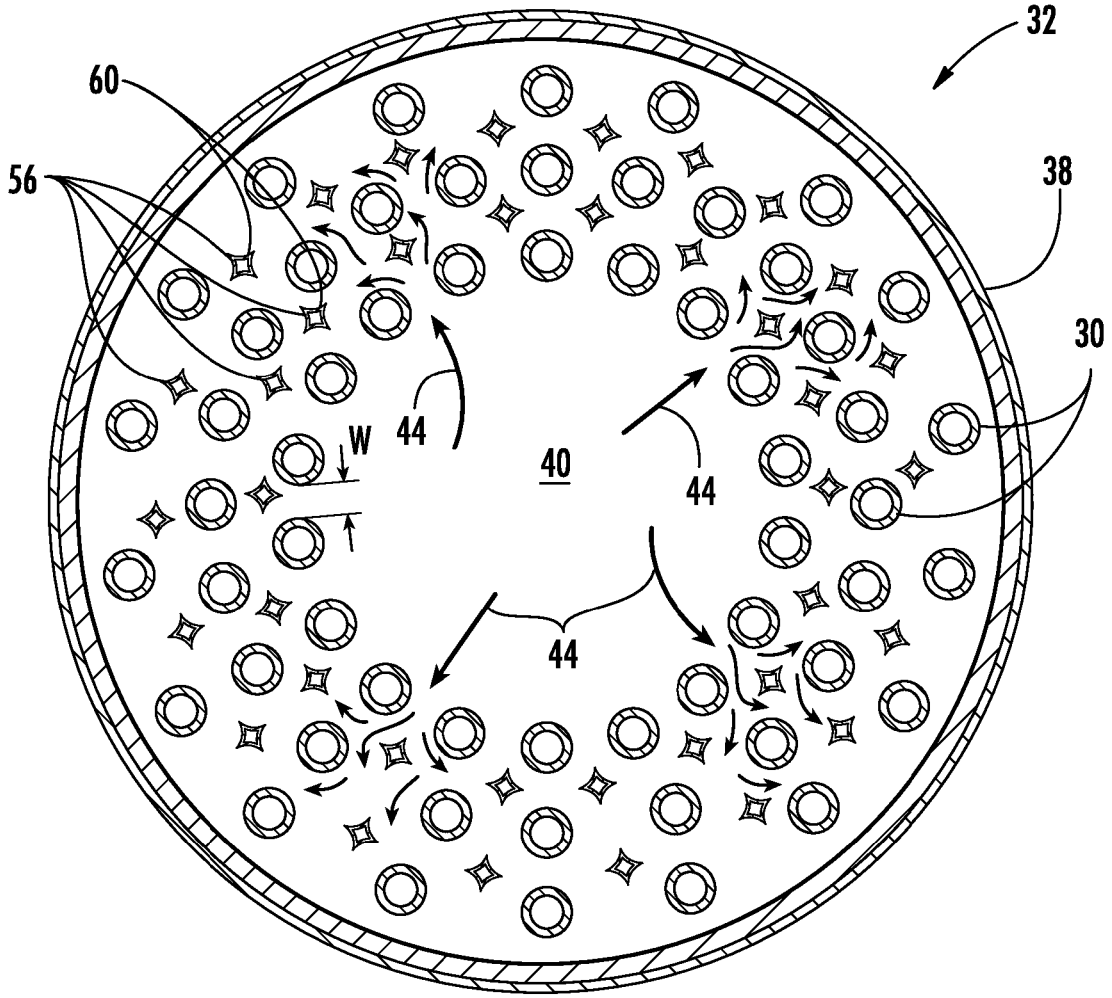
FIG. 7 is an axial cross-section view of the tube bundle shown in FIG. 4 taken along line C-C according to an alternate embodiment.

FIG. 4 provides an enlarged cross-section view of a tube bundle 32 shown in FIG. 1 taken along line A-A according to a second embodiment of the present invention, and FIGS. 5-7 provide axial cross-section views of the tube bundle 32 shown in FIG. 4 taken along line C-C according to various alternate embodiments. In the particular embodiment shown in FIGS. 4-7, the baffle 50 includes a plurality of rods 56 that redirects the fuel 44 around the tubes 30. Although shown as hollow rods 56 in each embodiment, the present invention is not limited to hollow rods 56 and may include solid rods 56 as well. As shown in FIGS. 5-7, the outer surface of the rods 56 may vary among the different embodiments. For example, in the embodiment shown in FIG. 5, each rod 56 has an angled outer surface 58 that deflects the fuel 44 around the tubes 30. Alternately, as shown in the embodiments illustrated in FIGS. 6 and 7, each rod 56 has an arcuate outer surface 60. Specifically, in the embodiment shown in FIG. 6, the arcuate outer surface 60 is generally circular or convex. Alternately, the arcuate outer surface 60 may be concave as shown in the particular embodiment illustrated in FIG. 7. The particular shape, size, and number of rods 56 will depend on various operational factors, including but not limited to the size of the tube bundle 32, the number of tubes 30 in the tube bundle 32, the anticipated fuel type, the anticipated operating level and temperature, and/or the wall thickness of the tubes 30.

The various embodiments shown and described with respect to FIGS. 1-7 may also provide a method for distributing the fuel 44 in the combustor 10. For example, the method may include flowing the fuel 44 into the fuel plenum 40 defined at least in part by the upstream surface 34, downstream surface 36, shroud 38, and tubes 30. The method may further include impinging or impacting the fuel 44 against the baffle 50 that extends axially inside the fuel plenum 40 between adjacent tubes 30. In this manner, the fuel 44 may be distributed radially around the tubes 30. In particular embodiments, the baffle 50 may be angled axially with respect to the tubes 30 so that the impinging or impacting step distributes the fuel 44 axially in the fuel plenum 40.

The systems and methods described herein may provide one or more of the following advantages over existing nozzles and combustors. For example, the distribution of the fuel 44 around the tubes 30 enables the fuel 44 to flow more uniformly across all surfaces of the tubes 30. As a result, the heat exchange between the fuel 44 and the tubes 30 increases and reduces or eliminates localized hot spots along the tubes 30 that might lead to flame holding or flashback conditions. Alternately, or in addition, the more uniform fuel 44 distribution through the fuel plenum 40 results in more even fuel flow through the fuel ports 46 into the tubes 30, reducing any local hot streaks or high fuel concentrations in the combustion chamber 28 that might increase undesirable emissions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor, comprising:

a. a tube bundle that extends radially across at least a portion of the combustor, wherein the tube bundle comprises an upstream surface axially separated from a downstream surface, wherein the upstream surface is defined by a first plate and the downstream surface is defined by a second plate, wherein the first plate and the second plate define a fuel plenum therebetween;

b. a plurality of tubes that extends from the upstream surface through the downstream surface, wherein each tube provides fluid communication through the tube bundle, wherein each tube defines a fuel port in fluid communication with the fuel plenum and disposed between the upstream surface and the downstream surface of tube bundle, wherein the plurality of tubes comprises a first row of tubes annularly arranged about an axial centerline of the tube bundle and a second row of tubes coaxially aligned with and spaced radially outwardly from the first set of tubes; and c. a baffle that extends axially inside the fuel plenum and extends circumferentially around the first row of tubes, wherein the baffle is positioned radially between the first row of tubes and the second row of tubes, wherein the baffle defines a plurality of fuel flow paths for fuel to flow radially outwardly from the first row of tubes towards the second row of tubes.

2. The combustor as in claim 1, wherein the baffle extends axially from the upstream surface to the downstream surface.

3. The combustor as in claim 1, wherein the baffle extends substantially parallel to the plurality of tubes.

4. The combustor as in claim 1, wherein the baffle comprises a plurality of plates having perforations defining the plurality of fuel flow paths.

5. The combustor as in claim 4, wherein the perforations are radially aligned with the plurality of tubes.

6. The combustor as in claim 1, wherein the baffle comprises a plurality of circumferentially spaced rods, wherein each fuel flow path is defined between two circumferentially adjacent rods of the plurality of rods.

7. The combustor as in claim 6, wherein each rod has an arcuate outer surface.

8. The combustor as in claim 6, wherein each rod has an angled outer surface.

9. A combustor, comprising:

a. a tube bundle that extends radially across at least a portion of the combustor, wherein the tube bundle comprises an upstream surface axially separated from a downstream surface, wherein the upstream surface is defined by a first plate and the downstream surface is defined by second plate;

b. a shroud that circumferentially surrounds the first plate and the second plate, wherein the first plate, the second plate and the shroud at least partially define a fuel plenum inside the tube bundle;

c. a plurality of tubes that extends from the upstream surface through the downstream surface of the tube bundle, wherein each tube defines a fuel port in fluid communication with the fuel plenum and disposed between the first plate and the second plate within the fuel plenum, wherein each tube provides fluid communication through the tube bundle, wherein the plurality if the tubes comprises a first row of tubes annularly arranged about an axial centerline of the tube bundule and a second row of tubes coaxially aligned with and spaced radially outwardly from the first row of tubes; and d. a baffle that extends axially inside the fuel plenum and extends circumferentially around the first row of tubes, wherein the baffle is positioned radially between the first row of tubes and the second row of tubes, and wherein the baffle defines a plurality of fuel flow paths for fuel to flow radially outwardly from the first row of tubes towards the second row of tubes.

10. The combustor as in claim 9, wherein the baffle extends axially from the upstream surface to the downstream surface.

11. The combustor as in claim 9, wherein the baffle extends substantially parallel to the plurality of tubes.

12. The combustor as in claim 9, wherein the baffle comprises a plurality of plates circumferentially spaced and having perforations.

13. The combustor as in claim 12, wherein the perforations are radially aligned with the plurality of tubes.

14. The combustor as in claim 9, wherein the baffle comprises a plurality of circumferentially spaced rods.

15. The combustor as in claim 14, wherein each rod has an arcuate outer surface.

16. The combustor as in claim 9, wherein the combustor is incorporated into a turbo-machine.

17. A method for distributing fuel in a combustor, comprising:

a, flowing a fuel into a fuel plenum defined at least in part by an upstream surface, a downstream surface axially separated from the upstream surface, a shroud that circumferentially surrounds the upstream and downstream surfaces, and a plurality of tubes that extend from the upstream surface to the downstream surface, wherein the plurality of tubes comprises a first row of tubes annularly arranged about an axial centerline and a second row of tubes coaxially aligned with and spaced radially outwardly from the first row of tubes; and b. impinging the fuel against a baffle that extends axially inside the fuel plenum, wherein the baffle is positioned radially between the first row of tubes and the second row of tubes, wherein the baffle defines a plurality of radial fuel flow paths which allow the fuel to flow radially through the baffle towards the second row of tubes.

18. The method as in claim 17, wherein the impinging step comprises impinging the fuel against the baffle extending from the upstream surface to the downstream surface.

19. The method as in claim 17, Wherein the impinging step comprises impinging the fuel against the baffle extending substantially parallel to the plurality of tubes.

20. The method as in claim 17, wherein the impinging step comprises impinging the fuel against the baffle between radially adjacent tithes of the plurality of tubes.

* * * * *